United States Patent [19]

Sasahara

[11] 4,062,534

[45] Dec. 13, 1977

[54] STRIPPER ARRANGEMENT FOR REMOVING VARIOUS SIZED COPY SHEETS FROM FUSER ROLL

[75] Inventor: Akira Sasahara, Ebina, Japan

[73] Assignee: Rank Xerox Ltd., London, England

[21] Appl. No.: 726,868

[22] Filed: Sept. 27, 1976

[30] Foreign Application Priority Data

Jan. 30, 1976 Japan ..... 51-008637[U]

[51] Int. Cl.[2] ..... B65H 29/56

[52] U.S. Cl. ..... 271/174; 118/245; 271/DIG. 2; 432/60

[58] Field of Search ..... 271/DIG. 2, 80, 174; 432/60; 118/60, 245; 34/120; 100/174

[56] References Cited

U.S. PATENT DOCUMENTS

| | | | |
|---|---|---|---|
| 2,348,355 | 5/1944 | Miller | 271/DIG. 2 |
| 3,450,402 | 6/1969 | Weiler | 271/DIG. 2 |
| 3,744,790 | 7/1973 | Hoffman | 271/DIG. 2 |
| 3,957,423 | 5/1976 | Mueller | 271/DIG. 2 |

*Primary Examiner*—Bruce H. Stoner, Jr.

[57] ABSTRACT

A stripping mechanism for removing copy paper from a heated fuser roll includes a first pair of stripping pawls spaced a first distance suitable for optimally stripping copy paper of a first size and a second pair of stripping pawls supported independently from the first pair and spaced a second distance suitable for optimally stripping copy paper of a second size. The first and second pairs of pawls contact the fuser roll at different locations along the circumference thereof.

1 Claim, 2 Drawing Figures

STRIPPER ARRANGEMENT FOR REMOVING VARIOUS SIZED COPY SHEETS FROM FUSER ROLL

BACKGROUND OF THE INVENTION

This invention relates to a contact-type heat-fixing device for use in an electrophotographic copying machine in which sets of stripping pawls are provided in contacting relationship with the surface of heat roll the spacing between pawls of each set being in accordance with the size of copy papers.

Conventionally, a contact-type heat-fixing device for use in an electrophotographic copying machine is of the type, in which copy sheets having thereon toner images are passed between a heated fixing roll and a pressure roll thereby to heat-fix the aforesaid toner images on the copy sheets. However, the copy sheet is likely to stick to the fixing roll in fixing and it becomes necessary to strip the copy sheet after fixing of the fixing roll. To this end, the tip ends of stripping pawls have heretofore been held in contact with the surface of the fixing roll to forcibly strip off the copy sheet stuck or adhered to the fixing roll. The aforesaid stripping pawls are spaced at a distance from each other on the fixing roll, because if they are provided over the whole width of the fixing roll, the fixing roll is damaged or deteriorated on the surface thereof. Conventionally, a couple of stripping pawls have been provided in such a manner that they are spaced at a distance to each other in accordance with only one size of copy sheet, with the tip ends thereof being held in contact with the fixing roll. However, with such an arrangement of stripping pawls, if the size of copy paper is set at A4, it becomes difficult to strip copy sheets of B4 size, while if the size of copy paper is set at B4, it becomes difficult to strip copy sheets of A4 size, leading to some problems in the subsequent stripping operation. Thus, in order to be useful for copy papers of all sizes, it has heretofore been the practice to provide stripping pawls at an intermediate distance, therefore, one which is neither optimum for the A4, nor the B4 size copy paper. However, with copy paper of small size, such as B5 the central portion is deflected downwardly between the stripping pawls, while with copy paper which is larger in size than B5, the both end portions are deflected downwardly, thereby resulting in the cause for paper-folding.

The present invention contemplates to eliminate the aforesaid problem and has as its object the provision of a contact-type heat-fixing device wherein sets of stripping pawls are provided in a manner to be held in contact with a fixing roll wherein the spacing between pawls of different sets is in accordance with various sizes of copy papers to be stripped thereby to enable stripping copy sheets of various sizes off the fixing roll in a reliable manner.

BRIEF SUMMARY OF THE INVENTION

Briefly, the objects of the present invention are accomplished, in a first embodiment of the invention, by the provision of a stripping pawl mechanism associated with a heated fuser roll which mechanism comprises a first set of pawls which are spaced apart a distance suitable for reliably stripping copy paper of a first predetermined size. A second set of pawls forming an integral part of the mechanism are spaced apart a suitable distance for stripping copy paper of a second predetermined size.

In a modified form of the invention, as illustrated in FIG. 2, the second set of pawls are independently supported relative to the first set and contact the heated roll at a different location on the circumference thereof relative to the first set of pawls. In addition to reliably stripping different sized copy substrates, the embodiment of FIG. 2 also provides, at least in the case of the largest size copy substrates, a system which provides increased reliability since if the first set of stripping pawls misstrip then the copy paper still has a chance of being stripped by the second set of stripping pawls.

Other objects and advantages of the present invention will become apparent when read in conjunction with the accompanying drawings wherein:

FIG. 1 is a schematic perspective view illustrating one embodiment of the invention; and FIG. 2 is a schematic perspective view of a modified form of the invention.

DETAILED DESCRIPTION OF THE PREFERRED EMBODIMENTS

Figure 1:
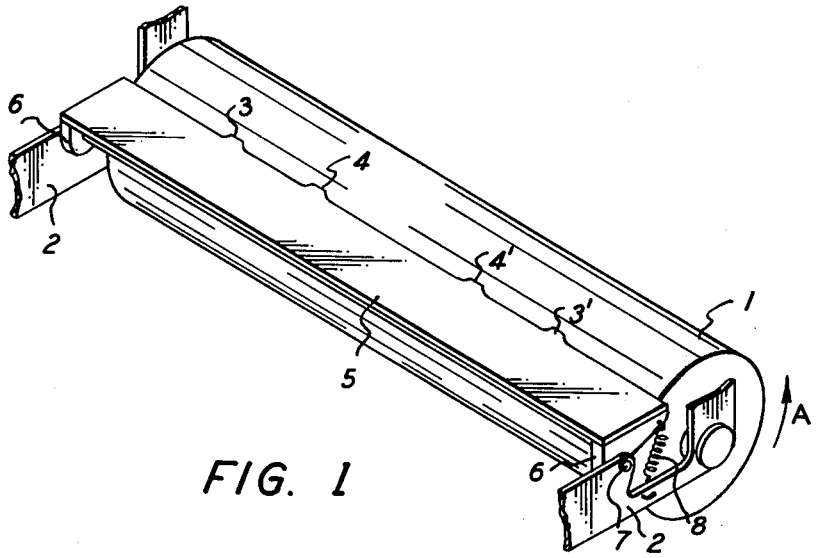

Now, the present invention will be described in more detail with reference to the accompanying drawings which show, by way of example, preferred embodiments of the present invention, in which:

Shown in 1 is a fixing roll of a contact-type heat-fixing device which is not shown. Shown at 2 are frames supporting the shaft 1*a* of said fixing roll 1. A supporting plate 5 is provided between said frames 2. The supporting plate 5 has fixed thereto attaching members 6 at both of the end portions. The lower portion of each of the attaching members 6 is rotatably supported on the aforesaid frame 2 by means of pin 7. On the periphery portion of said supporting plate 5 at the side of the fixing roll 1 there are provided, for example, four stripping pawls 3, 3' and 4, 4' disposed in a manner to form two pairs of striping pawls. Among these stripping pawls, the pawls 3, 3' which are located outwardly are spaced at a distance which is most suitable for stripping copy sheet, not shown, such as A4 and B4, while the pawls 4, 4' which are located inwardly of the pawls 3, 3' are spaced at a distance which is most suitable for stripping copy sheet such as B5. These stripping pawls 3, 3' and 4, 4' are arranged with the tip end portions being held in contact with the surface of the fixing roll 1 by means of tension springs 8 which are supported between said attaching members 6 and the frames 2.

In the embodiment shown in FIG. 1 two sets of stripping pawls, therefore, a first set 3, 3' and a second set 4, 4' with a different distance between the pawls of each set are provided on the same supporting plate 5, however, it may be possible to provide stripping pawls 3, 3' for use with A4 and B4 on the supporting plate 5 and the other stripping pawls 9, 9' for use with B5 on the lower side of the supporting plate 5. The other stripping pawls 9, 9' may be of the type, in which the tip ends of the stripping pawls 9, 9', which pawls are of triangular shape with the base ends thereof supported by supporting means 10, 10', are pulled downwardly by the force of tension springs 11, 11' to such an extent as to be in slidingly contacting relationship with the surface of the fixing roll 1. However, said pawls 9, 9' may be of other construction.

Thus, the copy papers (not shown) stuck to the fixing roll 1 after fixing reach at the ends thereof the stripping pawls 3, 3' or 4, 4' as the fixing roll 1 rotates in the direction as shown by arrow A. With the foregoing in view, if the size of paper is A4 or B4, it can be stripped off the fixing roll by means of the stripping pawls 3 and 3', while papers of B5 size can be stripped off the fixing roll by means of the stripping pawls 4 and 4'. As is mentioned above, with the construction according to the invention, the supporting plate 5 serves as a guide plate for feeding papers, thus presenting improved feeding of the paper after stripping.

Figure 2:
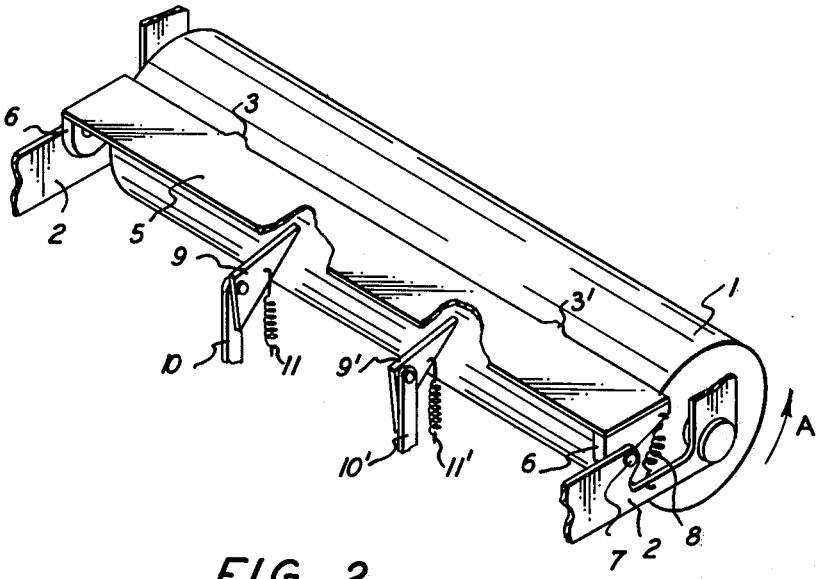

Likewise, as shown in FIG. 2, papers of A4 or B4 size can be stripped by the stripping pawls 3 and 3', while papers of B5 size are passed between the stripping pawls 3 and 3', stripped by the stripping pawls 9 and 9' which are located below said means 3 and 3', and then discharged out of a copying machine by a feeding means which is not shown. With such construction, even if papers of A4 or B4 size are not stripped by the stripping pawls 3 and 3', they can be stripped by the stripping pawls 9 and 9'. As is apparent from the foregoing detailed description, according to the present invention, at least two sets of stripping pawls are provided in a manner to be held in contacting relationship with the surface of fixing roll, whereby papers of different sizes can be stripped off the fixing roll in a reliable manner. Another advantage of the invention is to solve such a problem as paper-folding which is caused by deflection of the paper and occurs in the feeding process. Furthermore, since such stripping pawls can be attached to the existing fixing device, it is easy and inexpensive to put the present invention into practice.

While the invention has been described in conjunction with the preferred embodiments of the invention, various modifications will become apparent to those skilled in the art, and it is intended that such modifications be covered by the claims appended hereto.

What is claimed is:

1. In a contact heat fixing device including a heated roll for use in electrophotographic copying apparatus, stripping mechanism for stripping copy paper from a heated fuser roll to which the copy paper tends to adhere by virtue of tacky toner material forming images on the copy paper; said stripping apparatus comprising:

a first set of stripping pawls supported in contact with said heated roll, said first set of stripping pawls being spaced apart a first predetermined distance suitable for optimally stripping copy paper of a first size;

a second set of stripping pawls supported in contact with said heated roll, said second set of stripping pawls being spaced apart a second predetermined distance suitable for optimally stripping copy of a second size different from said first size;

said first set of stripping pawls being formed integrally to a support plate mounted for pivotal movement relative to said heated roll and said second set of stripping pawls being pivotably supported independently of said first set of stripping pawls for engagement with said heated fuser roll; and said first and second sets of stripping pawls contacting said heated fuser roll at different locations along the circumference thereof.

* * * * *